US011220859B2

(12) United States Patent
Hendrix

(10) Patent No.: US 11,220,859 B2
(45) Date of Patent: Jan. 11, 2022

(54) ELECTROMAGNETICALLY OPERATED PROTECTION MECHANISM, SYSTEM, AND METHOD

(71) Applicant: John Hendrix, Anderson, IN (US)

(72) Inventor: John Hendrix, Anderson, IN (US)

( * ) Notice: Subject to any disclaimer, the term of this patent is extended or adjusted under 35 U.S.C. 154(b) by 68 days.

(21) Appl. No.: 16/717,729

(22) Filed: Dec. 17, 2019

(65) Prior Publication Data

US 2020/0208468 A1 Jul. 2, 2020

Related U.S. Application Data

(60) Provisional application No. 62/786,724, filed on Dec. 31, 2018.

(51) Int. Cl.

| | |
|---|---|
| ***E06B 9/68*** | (2006.01) |
| ***F41H 5/26*** | (2006.01) |
| ***E06B 9/42*** | (2006.01) |

(52) U.S. Cl.

CPC ..... *E06B 9/68* (2013.01); *E06B 9/42* (2013.01); *F41H 5/26* (2013.01)

(58) Field of Classification Search

CPC ..... E06B 9/68; E06B 9/70; E06B 9/42; E06B 9/69; E06B 9/13; F41H 5/26; F41H 5/24

See application file for complete search history.

(56) References Cited

U.S. PATENT DOCUMENTS

| | | | | |
|---|---|---|---|---|
| 983,663 | A * | 2/1911 | White | E06B 9/88 160/3 |
| 9,702,665 | B1 | 7/2017 | Rose, Jr. et al. | |
| 9,741,221 | B1 | 8/2017 | Rehfeld et al. | |
| 10,151,566 | B2 * | 12/2018 | Adrain | E06B 9/68 |
| 10,209,036 | B1 * | 2/2019 | Rose, Jr. | F41H 5/26 |
| 2016/0230444 | A1 * | 8/2016 | Hahn | F41H 5/06 |

(Continued)

FOREIGN PATENT DOCUMENTS

| | | | | |
|---|---|---|---|---|
| CA | 2573235 A1 | | 8/2006 | |
| WO | WO 03052229 | * | 6/2003 | E06B 5/10 |
| WO | 2018055051 A1 | | 3/2018 | |

OTHER PUBLICATIONS

At web address: www.safetysecurity.co/bulletproof-blinds/ published before Dec. 15, 2019 published by Heracles Research Corp.

(Continued)

*Primary Examiner* — Beth A Stephan

(74) *Attorney, Agent, or Firm* — Brannon Sowers & Cracraft PC

(57) ABSTRACT

A room protection mechanism for protecting access through a window or doorway includes a flexible barrier sheet adjustable between a collapsed, storage configuration, and a deployed configuration. The protection mechanism includes a housing storing the flexible barrier sheet in the collapsed configuration. Sheet magnetic elements are attached to the flexible barrier sheet, and structured to magnetically couple to frame magnetic elements mounted to a frame of the doorway or window. The protection mechanism can be deployed, such as in a school or other institutional setting, to position the flexible barrier sheet to block access through the doorway or window. The flexible barrier sheet may be formed of or include a ballistic material.

18 Claims, 4 Drawing Sheets

(56) References Cited

U.S. PATENT DOCUMENTS

| | | | | |
|---|---|---|---|---|
| 2019/0113312 | A1 | 4/2019 | Adrain | |
| 2020/0393217 | A1* | 12/2020 | Adrain | B60J 1/2088 |

OTHER PUBLICATIONS

At web address: www.homedepot.com/p/High-Tech-Pet-12-3-4-in-x-25-in-Armor-Flex-Weather-Energy-Efficient-Pet-Door-with-Magnetic-Closure-for-Doors-or-Walls-AF2-XL/307644762 published before Dec. 15, 2019 by Home Depot.

At web address: www.cnn.com/2019/03/25/health/classroom-security-devices-school-shooting-trnd/index.html published on Mar. 26, 2019 by Michelle Lou and Brandon Griggs, CNN.

At web address: www.dogwarehouze.com/products/multi-function-magnetic-door www.safetysecurity.co/bulletproof-blinds/ published before Dec. 15, 2019 by dogwarehouze.com.

At web address: www.bigthink.com/politics-current-affairs/architecture-mass-shooting?rebelltitem=2#rebelltitem2 published on Sep. 19, 2020 by Scotty Hendricks.

At web address: www.communityresponsesystems.com/blog/panic-buttons-for-banks/ published on Jan. 16, 2019 by Laura Ray.

At web address: www.pcmag.com/roundup/367402/the-best-diy-smart-home-security-systems, Updated on Apr. 9, 2020 by John R. Delaney.

Screen capture of photo published on the World Wide Web at web address: www.i.groupme.com/1573x821.png.21ed0a1c14a047209a8033feefe82f5c published before Dec. 15, 2020 by unknown.

At web address: i.pinimg.com/736x/4a/c7/0d/4ac70d5bcb192f746d4af8cccfbe615b-window-blinds.jpg published before Dec. 15, 2019 by unknown.

At web address: www.bestmotorizedshades.com/ published before Dec. 15, 2019 by Best Motorized Shades.

At web address: www.saicoo.en.made-in-china.com/product/SCPQhafvXRVy/China-German-Insulated-Bulletproof-Roller-Shutters.html published before Dec. 15, 2019 by Focus Technology Co., Ltd.

At web address: www.bizjournals.com/kansascity/news/2018/03/12/kansas-fire-marshal-approves-fire-door-armor.html on Mar. 12, 2018 by James Dornbrook.

YouTube Citation #1 www.youtube.com/watch?v=pXrNjhDDTb0 Published Oct. 19, 2012 by David Turner.

YouTube Citation #2 www.youtube.com/watch?v=1NvNZJidtxE Published Feb. 11, 2013 by hardwirellc.

YouTube Citation #3 www.youtube.com/watch?v=8cCfxuUaABc Published Mar. 1, 2016 by Heracles Research Corp.

* cited by examiner

ELECTROMAGNETICALLY OPERATED PROTECTION MECHANISM, SYSTEM, AND METHOD

TECHNICAL FIELD

The present disclosure relates generally to protecting an area, and more particularly to a protection mechanism having a flexible barrier sheet electromagnetically connectable to a frame of a window or a doorway.

BACKGROUND

Protection of areas within a school or other institution is an acute challenge in modern society. The occurrence of intruders in schools, buildings, or other settings has motivated manufacturers and security authorities to propose a variety of counter measures in an effort to protect the lives and safety of individuals, notably children. Schools, for instance, are now typically equipped with various electronic monitoring systems to detect the presence or entry of intruders. Safety officers are also often employed to monitor the safety status of institutions, and take action as warranted.

Security systems have also been proposed, and some commercially implemented, that enable personnel at a central control station to remotely lock doors or other access points to buildings, hallways, and rooms. One security device is set forth in U.S. Pat. No. 9,702,664 to Rose, Jr. et al. and proposes a ballistic shade system for rolling up and down ballistic material and holding it in place during a ballistic event. Rose, Jr. et al. propose sidetracks forming channels designed to be mounted to the left and right of an opening in a wall. The sidetracks channel edges of ballistic material up and down and hold the edges in to ostensibly prevent their pushing out of the channel when a ballistic event hits the ballistic material. The design of Rose, Jr. et al. may have some applicability, but it is complex and appears relatively labor intensive to install.

SUMMARY OF THE INVENTION

In one aspect, a room protection mechanism includes a flexible barrier sheet having a first end, a second end, a first longitudinal edge, and a second longitudinal edge. The first longitudinal edge and the second longitudinal edge each extend between the first end and the second end, and the flexible barrier is adjustable between a collapsed, storage configuration, and a deployed configuration for positioning the first and the second longitudinal edges adjacent to a frame of a window or a doorway. The room protection mechanism further includes a housing structured to store the flexible barrier sheet in the collapsed configuration, and a retention element within the housing and attached to the first end of the flexible barrier sheet. The room protection mechanism further includes sheet magnetic elements attached to the flexible barrier sheet and distributed along each of the first longitudinal edge and the second longitudinal edge. The sheet magnetic elements are structured to magnetically couple to frame magnetic elements mounted to the frame. The room protection mechanism also includes an electrical switch structured to energize at least one of the sheet magnetic elements or the frame magnetic elements to magnetically attach the flexible barrier sheet to the frame.

In another aspect, a protection system includes a protection mechanism for a doorway or a window having a flexible barrier sheet with a first end, a second end, a first longitudinal edge and a second longitudinal edge. The protection mechanism further includes a housing structured to store the flexible barrier sheet in a collapsed configuration. The protection mechanism further includes sheet magnetic elements attached to the flexible barrier sheet and distributed along each of the first longitudinal edge and the second longitudinal edge, and frame magnetic elements structured for mounting upon or adjacent to a frame of a doorway or a window. The protection mechanism further includes an electrical switch structured to energize at least one of the sheet magnetic elements or the frame magnetic elements.

In still another aspect, a method of protecting access through a doorway or a window includes deploying a flexible barrier sheet to block a doorway or a window, energizing electromagnets resident on the flexible barrier sheet or a frame of the doorway or the window, and magnetically attaching the flexible barrier sheet to the frame based on the energizing of the electromagnets.

DETAILED DESCRIPTION

Figure 1:
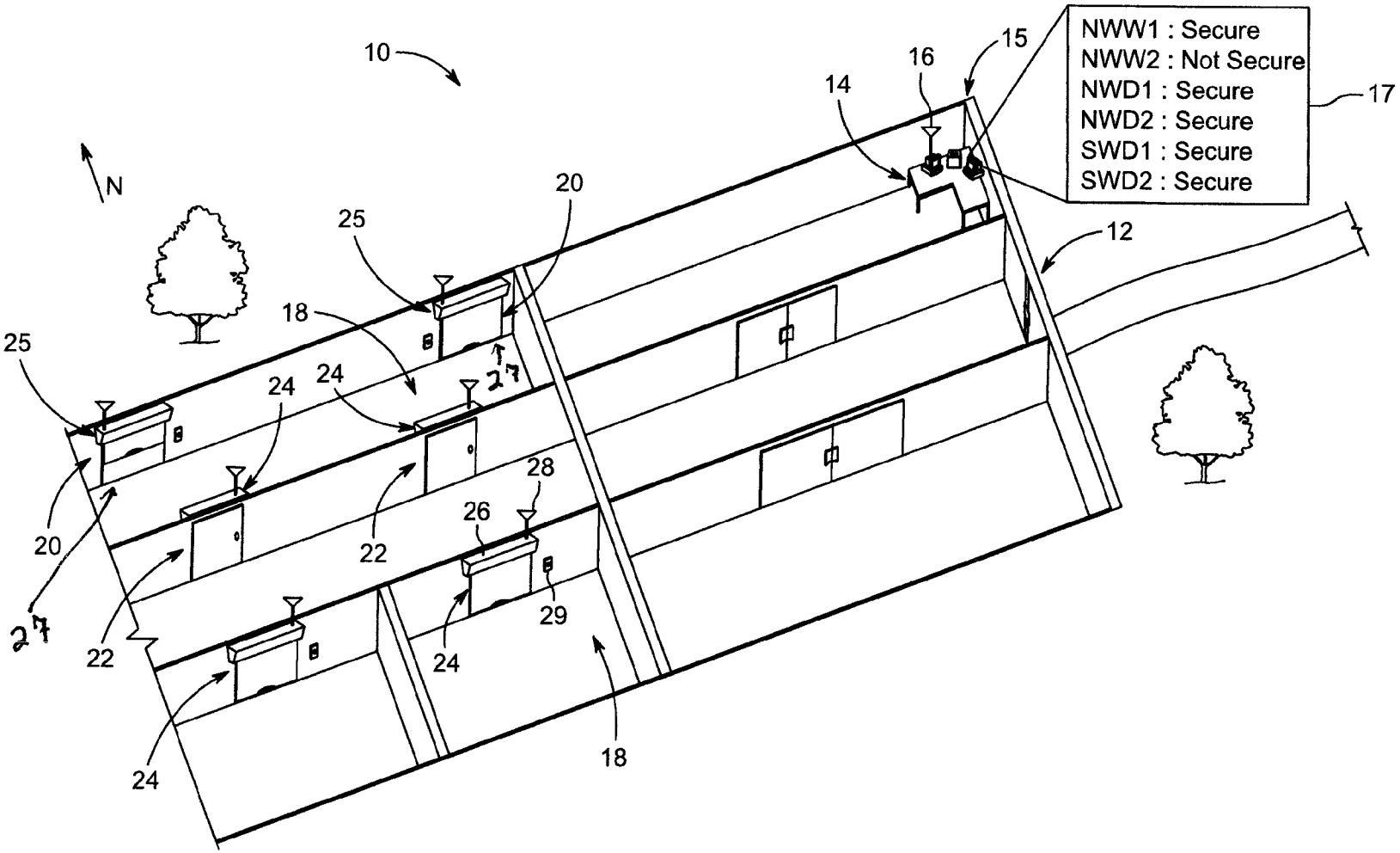
FIG. 1 is a diagrammatic view of a protection system, according to one embodiment.

Referring to FIG. 1, there is shown a protection system 15 for use in an institution 10, such as a school, an office building, a military base, an apartment building or condominium, or a variety of others. Protection system 15 or aspects thereof could be implemented in a residential home, a warehouse, or in still other environments. Institution 10 includes a main entrance 12 having a plurality of rooms 18 therein. Each of rooms 18 is shown having doors or doorways 22, windows 20, and additional rooms and interior hallways are shown. System 15 also includes a control station 14 where one or more personnel can be situated to monitor and potentially control functions of system 15. A receiver 16 is shown at control station 14, and could include a radio receiver, a Bluetooth receiver, an ultrasonic receiver, a wired electronic receiver, or any other receiver capable of receiving remotely transmitted data or control signals notifying personnel at control station 14 of the state of aspects of system 15 as further discussed herein. Control station 16 can include a display 17 such as a graphical user interface displayed on a computer, indicative of a security state of windows and doors and associated protection mechanisms in institution 10. In the illustrated example, display 17 includes graphics indicating NWW1: SECURE, NWW2: NOT SECURE, NWD1: SECURE, NWD2: SECURE, SWD1: SECURE, SWD2: SECURE. NWW1 could mean northwest window 1, NWW2 could mean northwest window 2, NWD1 could mean northwest door 1, NWD2 could mean northwest door 1, SWD1 could mean southwest door 1, and SWD2 means southwest door 2. The example information presented on display 17 could include many different forms, and the directional indicators shown could alternatively expressed. Instead of graphics, lights or lamps could be used. Additional information might be displayed on display 17 such as overall system status such as ON or OFF, alerts indicating the presence of an intruder, or still other information. Control station 14 could also be equipped with a master controller structured, for example, to deploy some or all of a plurality of protection mechanisms of system 15 as further discussed herein.

In a practical implementation strategy each room 18 is equipped with at least one room protection mechanism, and as illustrated each room 18 may be equipped with multiple door or doorway protection mechanisms 24 and multiple window protection mechanisms 25. Window protection mechanisms 25 and doorway protection mechanisms 24 may be similar and/or substantially identical to one another in some embodiments, but potentially different with respect to dimensions and proportions suited to the slightly different applications of a doorway or a window. It will be recalled that display 17 presently indicates northwest window 2 is not secure. All of the other protection mechanisms 24 and 25 in the illustrated case are indicated as secure. This might mean that northwest window 1 is not fully, or not at all, secured, whereas the other windows and doors are secured. A secure state or not secure state could represent that a control switch has or has not, respectively, been actuated, or that an electrical energy state of the subject protection is or is not as expected. Position feedback of a barrier sheet in a protection mechanism could be used to indicate present state on display 17. Doorways are identified with reference numeral 22 in FIG. 1 and windows shown by way of reference numeral 27.

Each protection mechanism 24 and 25 can be equipped with a transmitter 28 structured to communicate, for example, wirelessly with control station 14. Discussion herein of any one of protection mechanisms 24 or 25 should be understood by way of analogy to refer to any other of protection mechanisms 24 or 25, except where indicated otherwise or apparent from the context. Room protection mechanisms 24, hereinafter referred to in the singular, may include a housing 26 mounted to a building wall or the like, adjacent to the subject doorway or window to be protected such as about it. Transmitter 28 can be mounted to housing 26, or mounted separately from housing 26, and structured to transmit signals indicative of a present state of protection mechanism 24 to control station 14. Transmitter 28 could also be structured as a transceiver, to receive a control signal, data, or even a software upgrade, from control station 14. An electrical power connector switch 29 is shown mounted adjacent to protection mechanism 24, and can energize protection mechanism 24 for deployment and securing as further discussed herein.

Figure 2:
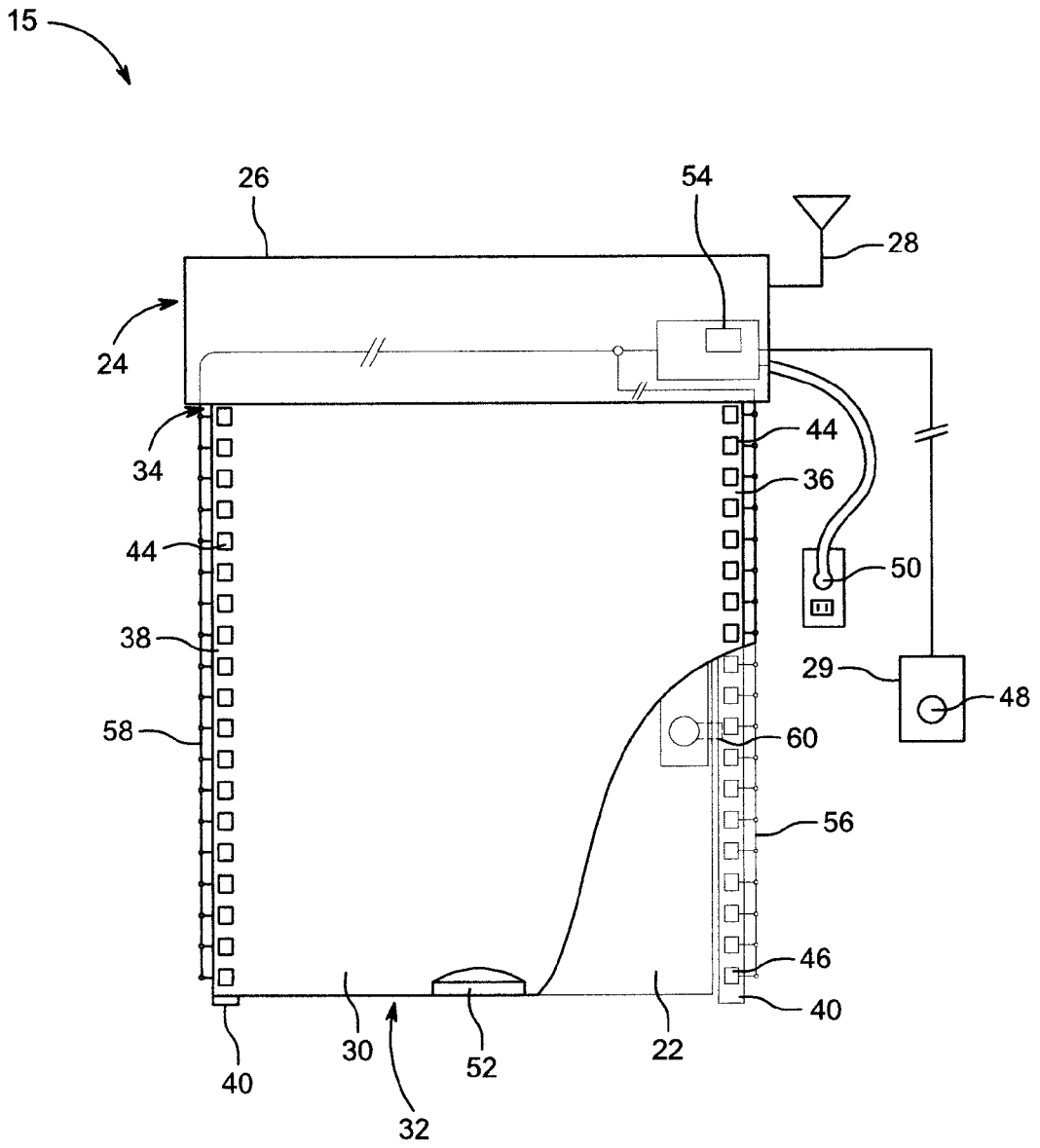
FIG. 2 is a partially open front diagrammatic view of a protection mechanism, according to one embodiment.
Figure 3:
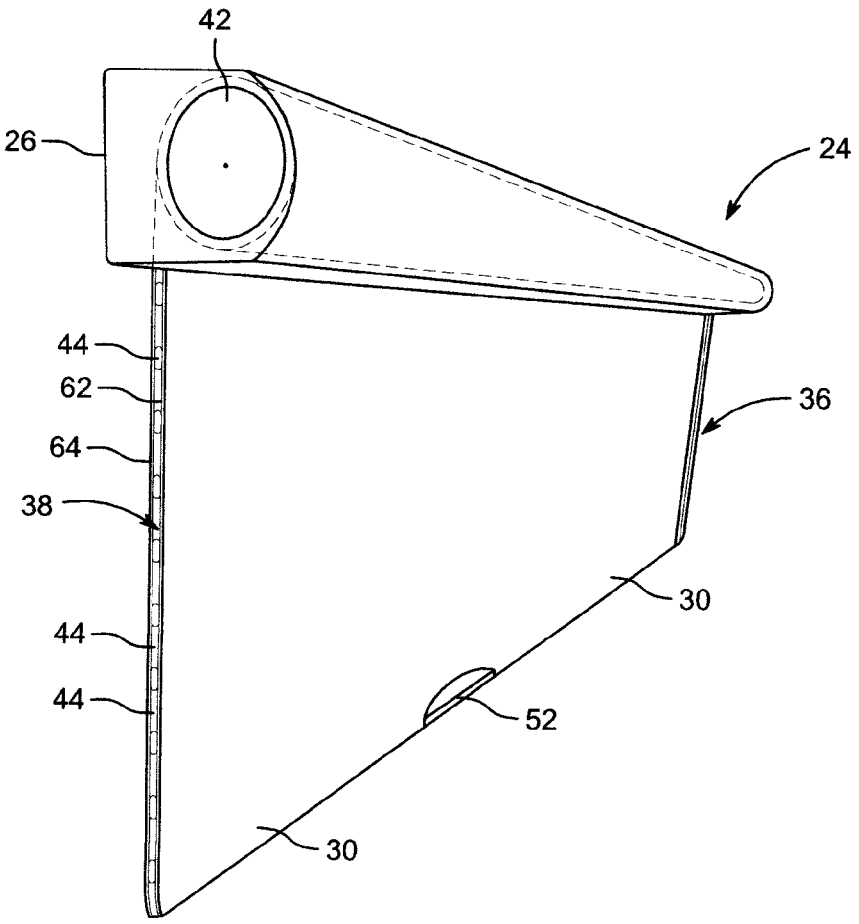
FIG. 3 is a perspective view of a protection mechanism, according to one embodiment.

Referring also now to FIG. 2, there are shown additional features of protection mechanism 24. Protection mechanism 24 includes a flexible barrier sheet 30 having a first end 32, a second end 34, a first longitudinal edge 36 and a second longitudinal edge 38. Each of first longitudinal edge 36 and second longitudinal edge 38 extends between first end 32 and second end 34. Flexible barrier sheet 30 is adjustable between a collapsed, storage configuration, and a deployed configuration for positioning first and second longitudinal edges 36 and 38 adjacent to a frame 40 of a window or a doorway. Housing 26 is structured to store flexible barrier sheet 30 in the collapsed configuration, which can be a rolled up configuration. Sheet magnetic elements 44 are attached to flexible barrier sheet 30 and distributed along each of first longitudinal edge 36 and second longitudinal edge 38. Sheet magnetic elements 44 are structured to magnetically couple to frame magnetic elements 46 mounted to or adjacent to frame 40, as further discussed herein. Electrical power connector switch 27 can be wall-mounted adjacent to protection mechanism 24, and discussed above. Electrical power connector switch 29 can include a hand-operated switch, such as a control button 48, and is structured to energize at least one of sheet magnetic elements 44 or frame magnetic elements 46 to magnetically attach flexible barrier sheet 30 to frame 40. Switch 29 could be actuated a second time to de-energize electromagnetic elements in protection mechanism 24, or a wall plug could be disengaged where used. Protection mechanism 24 could also be equipped with a keyed off switch positioned outside the room to be protected. Referring also now to FIG. 3, protection mechanism 24 can include a retention element 42 within housing 26, and attached to first end 34 of flexible barrier sheet 30. Retention element 42 can include a roller tube or the like, as further discussed herein.

In a practical implementation strategy flexible barrier sheet 30 includes a non-metallic ballistic material. The non-metallic ballistic material may include a ballistic nylon fabric material in some embodiments. One example material is a woven nylon fabric, such as a woven nylon having a denier about 1000 d or greater. Also in a practical implementation strategy sheet magnetic elements 44 are formed of a ferromagnetic material, such as a magnetically soft iron, steel, a nickel-based material, mixtures or alloys of these, or still others. In still other embodiments, sheet magnetic elements 44 could themselves include electromagnets.

As depicted in FIG. 2, protection mechanism 24 may also include an electrical plug or other connector 50 structured to plug into an institutional electrical power system. Electrical power connector switch 29 could include an electrical switch that physically electrically connects power circuitry 54 of protection mechanism 24 to electrical grid or local power, or electrical power connector switch 29 could send a control signal to switches in electrical power circuitry 54 to establish suitable electrical connections. A first electrical connector line 56 is electrically connected with electrical power circuitry 54 and electrically connects frame magnetic elements 46 along a first side of frame 40. A second electrical connector line 58 may electrically connect circuitry 54 with frame magnetic elements 46 mounted along an opposite side of frame 40, as shown. Also depicted in FIG. 2 is a door 22 having a latch 60 latching door 22 to frame 40. It will be recalled that protection mechanisms structured for protecting a door may be similar to a protection mechanism for a protecting a window. Accordingly, frame magnetic elements 46 can be mounted in two sets to opposite sides of a doorway, or analogously mounted in two sets to opposite sides of a window. A handle 52 is shown at first end 32 of flexible barrier sheet 30, and can be used by a user to pull flexible barrier sheet 30 into place for deployment by unrolling flexible barrier sheet 30 from retention element 42.

Figure 4:
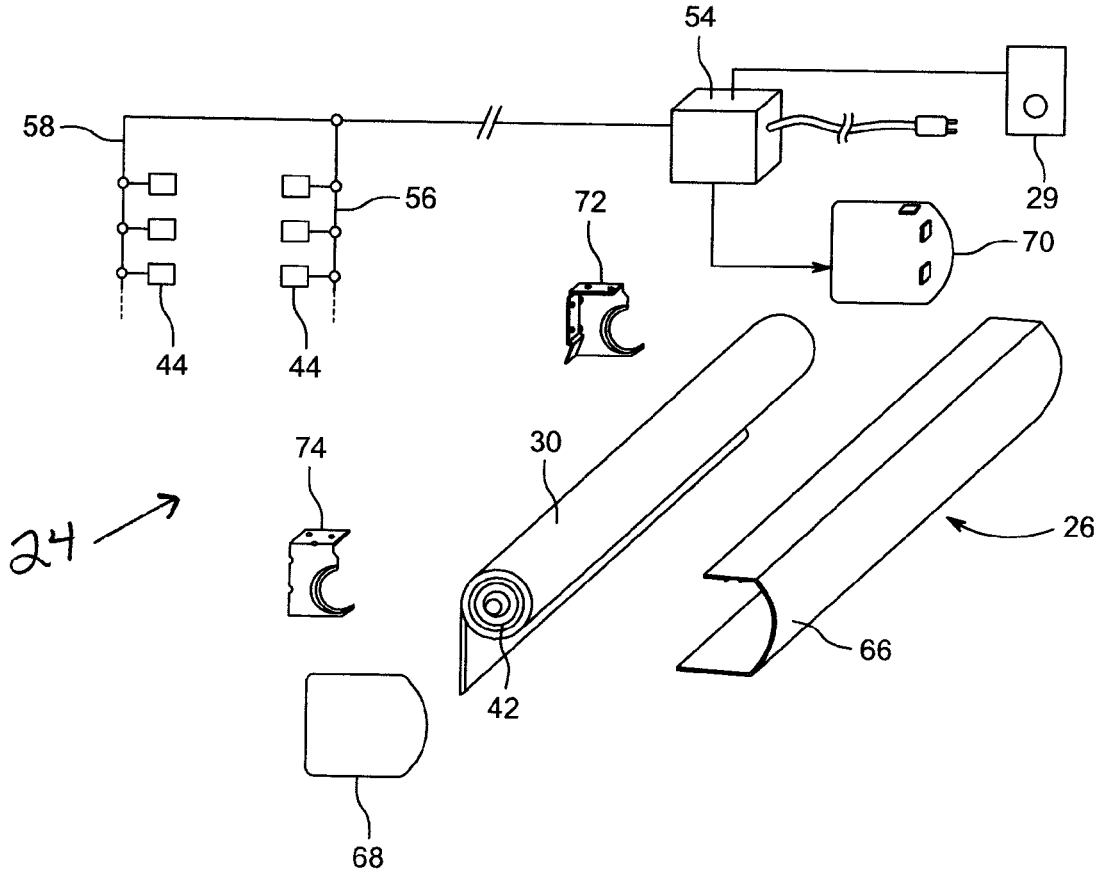
FIG. 4 is an exploded view of a protection mechanism, according to one embodiment.

Referring also now to FIG. 4, there are shown additional features of protection mechanism 24, including parts of housing 26. Housing 26 can include a first or main housing piece 66, a first housing end piece 68, and a second housing end piece 70 each structured to couple with opposite ends of main housing piece 66. Housing 26 can also include a first cradle 72, and a second cradle 74, structured to rotatably journal retention element or roller tube 42 when housing 26 is assembled. Power electronics or power circuitry 54 can be installed in housing 26, but could be mounted outside of and onto housing 26, or for example mounted on the wall adjacent to housing 26. Components as presented in FIG. 4 could be provided as a kit for installation by an end user or service technician.

Figure 5:
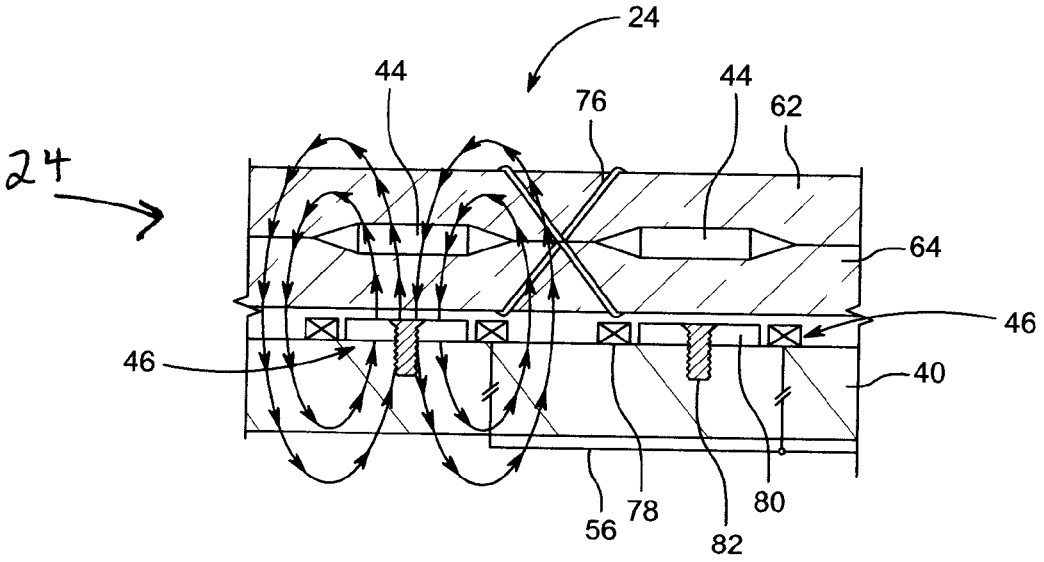
FIG. 5 is sectioned side diagrammatic view of a portion of a protection mechanism, according to one embodiment.

Referring also now to FIG. 5, there is shown a sectioned view with additional features of protection mechanism 24 shown. Flexible barrier sheet 30 may include a first sheet layer 62 and a second sheet layer 64. Sheet magnetic elements 44 can include iron pieces, iron flakes, or any other suitable ferromagnetic material trapped between sheet layer 62 and sheet layer 64. As can be seen from the illustration of FIG. 5 a stitch 76 connects sheet layer 62 to sheet layer 64 and secures sheet magnetic elements 44 therein. A plurality of stitches similar to stitch 76, can be distributed along each of first longitudinal edge 36 and second longitudinal edge 38 to trap sheet magnetic elements 44 within flexible barrier sheet 30. Other than sewing, various clams, clips, or adhesives could be used to secure sheet magnetic elements 44. Also shown in FIG. 5 are frame magnetic elements 46. In the illustrated embodiment, each of frame magnetic elements 46 can include a coil 78, such as an electrically conductive coil electrically connected with electrical connector line 56. Each frame magnetic element 46 may also include a core 80, formed of a suitable ferromagnetic material, that is attached to frame 40 by way of a fastener 82. It will thus be appreciated that a plurality of frame magnetic elements 46 can be mounted along the running length of each side of frame 40 and attached with fasteners 82. Each coil 78 may be attached to the corresponding core 80, for instance being housed together within a suitable housing or the like. It can be also seen in FIG. 5 that a magnetic field is produced by electrically energizing frame magnetic elements 46 as discussed herein, imparting a tendency for sheet magnetic elements 44 to be magnetically attracted towards frame magnetic elements 46, thereby magnetically attaching flexible barrier sheet 30 to frame 40 as discussed herein.

INDUSTRIAL APPLICABILITY

Referring to the drawings generally, protecting access through a doorway or a window according to the present disclosure can include deploying a flexible barrier sheet to block a doorway or a window, such as by manually manipulating the flexible barrier sheet, although the present disclosure is not thereby limited. Protecting access can further include energizing electromagnets resident on the flexible barrier sheet or a frame of the doorway or the window, and magnetically attaching the flexible barrier sheet to the frame based on the energizing of the electromagnets. In the embodiments discussed herein deploying of the flexible barrier sheet includes unrolling the flexible barrier sheet from a roller supported in a housing mounted above the doorway or window. In other embodiments, the flexible barrier sheet could be stored in a folded configuration, instead of a rolled up configuration, in a crumpled configuration, or still another. Moreover, the housing might be mounted to the side of a doorway or window, or even mounted at the bottom of the doorway or window and drawn upward to the deployed configuration. While using a wall switch mounted adjacent to the doorway or window provides a practical implementation strategy, in other embodiments, the energizing of the electromagnets could be performed from a remote control station, from a switch at a teachers desk, or still another way.

The present description is for illustrative purposes only, and should not be construed to narrow the breadth of the present disclosure in any way. Thus, those skilled in the art will appreciate that various modifications might be made to the presently disclosed embodiments without departing from the full and fair scope and spirit of the present disclosure. Other aspects, features and advantages will be apparent upon an examination of the attached drawings and appended claims. As used herein, the articles "a" and "an" are intended to include one or more items, and may be used interchangeably with "one or more." Where only one item is intended, the term "one" or similar language is used. Also, as used herein, the terms "has," "have," "having," or the like are intended to be open-ended terms. Further, the phrase "based on" is intended to mean "based, at least in part, on" unless explicitly stated otherwise.

What is claimed is:

1. A room protection mechanism comprising:

a flexible barrier sheet including a first end, a second end, a first longitudinal edge and a second longitudinal edge, each extending between the first end and the second end, and the flexible barrier sheet being adjustable between a collapsed, storage configuration, and a deployed configuration for positioning the first and the second longitudinal edges adjacent to a frame of a window or a doorway;

a housing structured to store the flexible barrier sheet, in the collapsed configuration;

a retention element within the housing and attached to the first end of the flexible barrier sheet;

sheet magnetic elements attached to the flexible barrier sheet and distributed along each of the first longitudinal edge and the second longitudinal edge, and the sheet magnetic elements being structured to magnetically couple to frame magnetic elements mounted to the frame; and an electrical switch structured to energize at least one of the sheet magnetic elements or the frame magnetic elements to magnetically attach the flexible barrier sheet to the frame.

2. The mechanism of claim 1 wherein the flexible barrier sheet includes a non-metallic ballistic material.

3. The mechanism of claim 2 wherein the non-metallic ballistic material includes a ballistic nylon material.

4. The mechanism of claim 1 wherein the electrical switch includes a hand-operated switch mounted externally to the housing.

5. The mechanism of claim 1 wherein the sheet magnetic elements are formed of a ferromagnetic material.

6. The mechanism of claim 5 wherein the flexible barrier sheet includes a plurality of sheet layers, and the sheet magnetic elements are trapped between the plurality of sheet layers.

7. The mechanism of claim 6 wherein the retention element includes a roller supported for rotation in the housing.

8. A protection system comprising:

a protection mechanism for a doorway or a window including a flexible barrier sheet having a first end, a second end, a first longitudinal edge and a second longitudinal edge, and a housing structured to store the flexible barrier sheet in a collapsed configuration;

the room protection mechanism further including sheet magnetic elements attached to the flexible barrier sheet and distributed along each of the first longitudinal edge and the second longitudinal edge, and frame magnetic elements structured for mounting upon or adjacent to a frame of the doorway or a window; and the room protection mechanism further including an electrical switch structured to energize at least one of the sheet magnetic elements or the frame magnetic elements.

9. The protection system of claim 8 wherein the flexible barrier sheet is adjustable between a collapsed, storage configuration, and a deployed configuration, and further comprising a roller attached to the first end of the flexible barrier sheet and supported for rotation in the housing.

10. The protection system of claim 9 wherein the flexible barrier sheet includes a ballistic material.

11. The protection system of claim 8 wherein the frame magnetic elements include electromagnets, and the electrical switch includes a hand-operated switch.

12. The protection system of claim 8 wherein the protection mechanism is one of a plurality of similar protection mechanisms for a plurality of doorways or windows, and further comprising a control station in communication, with each of the plurality of protection mechanisms and including a display having a plurality of indicators each having an indicator state linked to a state of one of the plurality of similar protection mechanisms.

13. A method of protecting access through a doorway or a window comprising:

deploying a flexible barrier sheet to block a doorway or a window;

energizing electromagnets resident on the flexible barrier sheet or a frame of the doorway or the window; and magnetically attaching longitudinal edges of the flexible barrier sheet to longitudinal edges of the frame based on the energizing of the electromagnets.

14. The method of claim 13 wherein the energizing of the electromagnets includes energizing electromagnetics mounted to, or adjacent to, the frame of the doorway or the window.

15. The method of claim 14 wherein the magnetically attaching the flexible barrier sheet includes magnetically attracting magnetic elements resident on the flexible barrier sheet.

16. The method of claim 14 wherein the deploying of the flexible barrier sheet includes deploying a flexible barrier sheet that includes a ballistic material.

17. The method of claim 16 wherein the deploying of the flexible barrier sheet includes unrolling the flexible barrier sheet from a roller supported in a housing mounted adjacent to the doorway or window.

18. The method of claim 13 wherein the energizing of the electromagnets includes energizing the electromagnets using a switch mounted adjacent to the doorway or window.

* * * * *